US010464079B2

(12) United States Patent
Zhou et al.

(10) Patent No.: US 10,464,079 B2
(45) Date of Patent: Nov. 5, 2019

(54) CONCEALED TOP COVER-TYPE SHOWER HEAD

(71) Applicant: Xiamen Solex High-Tech Industries Co., Ltd., Xiamen (CN)

(72) Inventors: Huasong Zhou, Xiamen (CN); Donghai Chen, Xiamen (CN); Jianmin Chen, Xiamen (CN); Zhicong Lin, Xiamen (CN)

(73) Assignee: Xiamen Solex High-Tech Industries Co., Ltd., Xiamen, Fujian (CN)

( * ) Notice: Subject to any disclaimer, the term of this patent is extended or adjusted under 35 U.S.C. 154(b) by 632 days.

(21) Appl. No.: 14/360,881

(22) PCT Filed: Nov. 27, 2012

(86) PCT No.: PCT/CN2012/085309
§ 371 (c)(1),
(2) Date: May 27, 2014

(87) PCT Pub. No.: WO2013/078977
PCT Pub. Date: Jun. 6, 2013

(65) Prior Publication Data

US 2014/0346255 A1 Nov. 27, 2014

(30) Foreign Application Priority Data

Nov. 28, 2011 (CN) ..... 2011 1 0386730
Nov. 28, 2011 (CN) ..... 2011 2 0483789 U
Nov. 27, 2012 (WO) ..... 2013078977

(51) Int. Cl.
*B05B 1/18* (2006.01)
*B05B 1/16* (2006.01)

(52) U.S. Cl.
CPC ..... *B05B 1/185* (2013.01); *B05B 1/1654* (2013.01); *B05B 1/1672* (2013.01); *B05B 1/18* (2013.01)

(58) Field of Classification Search
CPC ..... B05B 1/185; B05B 1/1654; B05B 1/1672; B05B 1/18; B05B 3/04; B05B 1/1636; B05B 1/1645; B05B 1/1627
(Continued)

(56) References Cited

U.S. PATENT DOCUMENTS 4,303,201 A * 12/1981 Elkins ..... B05B 1/1636 239/381
4,703,893 A * 11/1987 Gruber ..... B05B 1/1618 239/391
(Continued)

FOREIGN PATENT DOCUMENTS

CA 2680208 A1 * 3/2011 ..... B05B 1/1654
CN 201180814 Y 1/2009
(Continued)

*Primary Examiner* — Arthur O. Hall
*Assistant Examiner* — Steven M Cernoch
(74) *Attorney, Agent, or Firm* — Cooper Legal Group, LLC

(57) ABSTRACT

A concealed top cover-type shower head, the shower head comprises a shower head body; an inlet base; a water diversion mechanism, the relative rotation of the water diversion mechanism and the inlet base makes the plurality of diversion waterways switched to connect to the water inlet holes, each set of which are annularly arranged with intervals and respectively connected to the diversion waterways; and a decorative cover, which is covered part or whole of the top cover and is rotatably assembled to the shower head body, the external periphery of the decorative cover and the external periphery of the inlet base are fixed together by an assembly component, the decorative cover is disposed with large throughout holes, the relative rotation of the
(Continued)

decorative cover and the top cover makes the plurality sets of the outlet nozzles switched to correspond to the large throughout holes.

11 Claims, 6 Drawing Sheets

(58) Field of Classification Search
USPC ..... 239/443
See application file for complete search history.

(56) References Cited

U.S. PATENT DOCUMENTS 5,213,267 A * 5/1993 Heimann ..... B05B 1/1681 239/446
5,433,384 A * 7/1995 Chan ..... B05B 1/1636 239/239
5,765,760 A * 6/1998 Kuo ..... B05B 1/1654 239/437
6,230,989 B1 * 5/2001 Haverstraw ..... B05B 1/044 239/443
6,247,656 B1 * 6/2001 Wales ..... B05B 1/185 239/552
6,460,783 B1 * 10/2002 Christopher ..... B05B 1/1654 239/391
6,715,699 B1 * 4/2004 Greenberg ..... B05B 1/1645 239/394
6,869,030 B2 * 3/2005 Blessing ..... B05B 1/1636 239/390
7,694,897 B2 * 4/2010 Bulan ..... B05B 1/18 239/436
7,766,260 B2 * 8/2010 Lin ..... B05B 1/18 239/389
7,937,784 B2 * 5/2011 Qiu ..... B05B 1/1618 4/661
8,028,935 B2 * 10/2011 Leber ..... B05B 15/65 239/436
8,066,203 B2 * 11/2011 Zhou ..... B05B 1/1636 239/443
8,297,534 B2 * 10/2012 Li ..... B05B 1/1654 239/222.11
2004/0195381 A1 * 10/2004 Luettgen ..... B05B 1/1654 239/463
2005/0263617 A1 * 12/2005 Thong ..... B05B 1/1636 239/383
2006/0043214 A1 * 3/2006 Macan ..... B05B 1/1654 239/222.11
2008/0223957 A1 * 9/2008 Schorn ..... B05B 1/185 239/428.5
2010/0038454 A1 * 2/2010 Shieh ..... B05B 1/02 239/393
2011/0084153 A1 * 4/2011 Qiu ..... B05B 1/1654 239/562
2011/0147477 A1 * 6/2011 Mang ..... B05B 1/1645 239/11
2011/0192915 A1 * 8/2011 Li ..... B05B 1/18 239/394
2014/0346255 A1 * 11/2014 Zhou ..... B05B 1/18 239/443

FOREIGN PATENT DOCUMENTS

CN 201195132 Y 2/2009
CN 102513235 A 6/2012
CN 202398445 U 8/2012
GB 2311474 A 10/1997
WO 9958726 11/1999

* cited by examiner

CONCEALED TOP COVER-TYPE SHOWER HEAD

This application is a national phase entry of PCT/CN2012085309, filed on Nov. 27, 2012, and claims the benefit of priority to CN 201120483789.2 and CN 201110386730.6, both filed on Nov. 28, 2011 with the State Intellectual Property Office of the People's Republic of China, the specifications of which are herein incorporated by reference.

FIELD OF THE INVENTION

The present invention relates to a shower head, especially to a concealed top cover type shower head.

BACKGROUND OF THE INVENTION

Existing shower head are mostly switched by linkage of a decorative cover and a top cover, the top cover is disposed with a plurality of outlet holes, the decorative cover has a plurality of outlet holes as well. Chinese patent database with publishing number CN201195132Y is provided with a multi-functional back-switching type hand shower head, which is disclosed with a shower head comprising a handle, an outlet housing and a switch device, the switch device comprises a switch rotation disk and a water diversion disk, the shower head is switched by rotating the switch device to control the outlet waterways. Although it is switched from a back side, the outlet housing is still disturbed with outlet holes, thus making the switch mechanism complicated and not attractive.

SUMMARY OF THE INVENTION

The present invention is provided with a concealed top cover type shower head.

The technical proposal of the present invention to solve the technical problems is that:

A concealed top cover type shower head, wherein comprising:

a shower head body (100), which is disposed with an inlet waterway (110);

an inlet base (200), which is rotatably mounted inside the shower head body (100) and disposed with inlet holes (210), the inlet holes (210) are connected to the inlet waterway (110);

a water dividing mechanism (300), which is fixed inside the shower head body (100) with a plurality of diversion waterways (311*a*, 311*n*, 331*c*) and a top cover (330), the relative rotation of the water diversion mechanism (300) and the inlet base (200) makes the plurality of diversion waterways (311*a*, 311*b*, 311*c*) switched to connect to the water inlet holes (210), the top cover (330) is disposed with a plurality sets of outlet nozzles (331), each set of which are annularly arranged, arranged with intervals and respectively connected to the diversion waterways (311*a*, 311*b*, 311*c*); and A decorative cover (500), which is covered part or whole of the top cover (300) and is rotatably assembled to the shower head body (100), the external periphery of the decorative cover (500) and the external periphery of the inlet base (200) are fixed together by an assembly component, the decorative cover (500) is disposed with large through holes, the relative rotation of the decorative cover (500) and the top cover (330) makes the plurality sets of the outlet nozzles switched to correspond to the large through holes.

In another preferred embodiment, the periphery of the water diversion mechanism (300) is protruded with several screw holes (350), the shower head body (100) is disposed with a plurality of screw bases (120) corresponding to the screw holes (350), a plurality of screws (600) pass through the screw holes (350) of the water diversion mechanism (300) and screw to the screw bases (120); one assembly component is disposed between each two adjacent screws (600); the water diversion mechanism is disposed between the inlet base (200) and the decorative cover (500).

In another preferred embodiment, the central portion of the top cover (300) is protruded with a projection (332), the decorative cover (500) is annular, the annular decorative cover (500) is rotatably sleeved on the projection (332) in sealing way.

In another preferred embodiment, the water diversion mechanism (300) further comprising a water diversion base (310), the water diversion base (310) abuts against the inlet base (200); the diversion waterways (311*a*, 311*b*, 311*c*) are disposed on the water diversion base (310), each diversion waterway (311*a*, 311*b*, 311*c*) is disposed with a diversion water hole (312), the diversion water holes (312) are switched to correspond to the inlet holes (210).

In another preferred embodiment, the water diversion mechanism (300) further comprising a connection base (320) with a plurality of water holes (321), the connection base (320), a water diversion base (310) and the top cover (330) are fixed together; the top surface of the connection base (320) is disposed with a plurality of assembly grooves (322), the assembly grooves (322) are coupled to and connected to the diversion waterways (311*a*, 311*b*, 311*c*) of the water diversion base (310), the water holes (321) are evenly arranged with intervals inside the assembly grooves (322); the bottom surface of the connection base (320) is disposed with a plurality sets of assembly cavities (323) of annularly arranged with intervals, each set of assembly cavity (323) is coupled to and connected to one set of outlet nozzles (331).

In another preferred embodiment, it comprises two inlet holes (210); six diversion water holes (312) divided into three sets of annularly arranged with intervals, two inlet holes (210) are respectively switched to connect to the three sets of diversion water holes (312); three diversion waterways (311*a*, 311*b*, 311*c*) mutually independent, a shower water waterway (311*a*), a spray water waterway (311*b*) and a injection water waterway (311*c*), three sets of the water holes (312) are respectively connected to the three diversion waterways (311*a*, 311*b*, 311*c*); the top surface of the connection base (320) is disposed with three assembly grooves (322) coupled to and connected to the three diversion waterways (311*a*, 311*b*, 311*c*), the water holes (321) are annularly arranged with intervals inside the three assembly grooves (322).

In another preferred embodiment, the top cover (330) is disposed with three sets of outlet nozzles (311) of annularly arranged with intervals, which are a shower water outlet nozzles (331*a*), a spray water outlet nozzles (331*b*) and an injection water outlet nozzles (331*c*); the bottom surface of the connection base (320) is disposed with three sets of assembly cavities (323) coupled to and connected to the three sets of outlet nozzles (331).

In another preferred embodiment, the water diversion mechanism (300) further comprising a sealing ring (360), the sealing ring (360) is sleeved between the water diversion base (310) and the inlet base (200) in sealing way; the inlet hole (210) is disposed with a spring (370) and a sealing piece (380) with a through hole, the sealing piece (380) is slidably disposed inside the inlet hole (210), the spring (370) abuts against the sealing piece (380) and the inlet hole (210); the external periphery of the decorative cover (500) is further disposed with a shifting block (510).

In another preferred embodiment, further comprising a water barrier (700) fixed to the shower head body (100) to close the inlet waterway (110); further comprising a packing ring (800), the packing ring (800) is sleeved between the inlet base (200) and the water barrier (700) in sealing way.

In another preferred embodiment, the water barrier (700) and the inlet base (200), the inlet base (200) and the water diversion base (310), the top cover (330) and the decorative cover (500) are respectively connected together by point contacts.

In another preferred embodiment, the internal wall of the external ring of the annular decorative cover (500) is disposed with a plurality of ribs (550), the internal ring of the annular decorative cover (500) is rotatably sleeved on the projection (332) of the top cover in sealing way, the top cover (330) and the decorative cover (500) are connected together by point contacts.

Compared to the existing technology, the technical proposal of the present invention has advantages as below:

1. the external periphery of the decorative cover and that of the inlet base are relatively fixed together by assembly component, the decorative cover is covered part or whole of the top cover, the decorative cover is disposed with large through holes, so that when rotating the decorative cover, the inlet base is driven to rotate with respect to the water diversion mechanism to switch different water patterns, so that the large through holes of the decorative cover are corresponding to the outlet nozzles of water patterns, water passes through the large through holes and flows out, the decorative cover is simple structural without that dense outlet nozzles, so that the shower head has attractive appearance, dense outlet nozzles on the top cover are invisible.

2. the water diversion mechanism is disposed between the inlet base and the decorative cover, the water diversion mechanism is screwed to the shower head body by screws, a small clearance is disposed therebetween in the axial direction by locking the travel of the screw, so that the inlet base is rotatable in the circumferential direction, and the inlet holes of the inlet base respectively align with the diversion water holes of the water diversion base to switch the waterway.

3. the central portion of the top cover is protruded to define a projection, the decorative cover is annular, the annular decorative cover is rotatably sleeved on the projection in sealing way, so the appearance is attractive, the decorative cover is rotatable about the projection, thus making it with smaller friction and more labor-saving when rotating the decorative cover.

4. the water diversion mechanism further comprises a water diversion base and a connection base, the connection base, the water diversion base and the top cover are fixed together, the water diversion holes of the diversion waterways are switched to correspond to the inlet holes, the waterway are switched by the connection base connecting to the outlet nozzles of the top cover, it is simple and compact structural.

5. the sealing ring is sleeved between the water diversion base and the inlet base in sealing way, the sealing piece is slidably disposed inside the inlet hole, the spring abuts against the sealing piece and the inlet hole, resulting in reducing friction effectively and ensuring a better handle feeling of switching.

6. the water barrier and the inlet base, the inlet base and the water diversion base, the top cover and the decorative cover are respectively connected together by point contacts, resulting in reducing friction effectively and ensuring a better handle feeling of switching.

BRIEF DESCRIPTION OF THE DRAWINGS

The present invention will be further described with the drawings and the embodiments.

FIG. 3 illustrates a sectional view of the concealed top cover type shower head of the preferred embodiment when no water flows in.

DETAILED DESCRIPTION OF THE EMBODIMENTS

Figure 1:
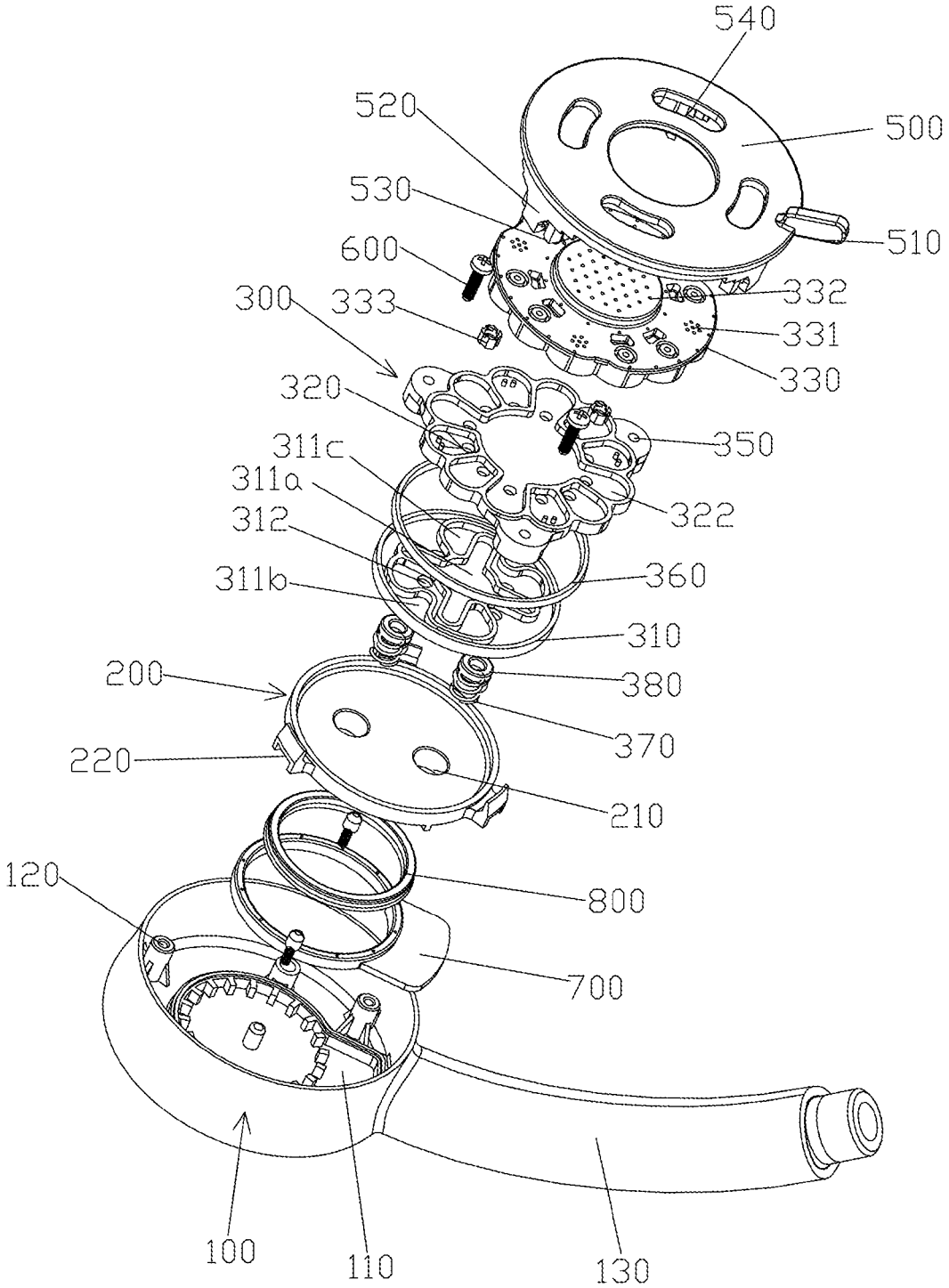
FIG. 1 illustrates an exploded diagram of a bottom view of a concealed top cover-type shower head of a preferred embodiment.
Figure 2:
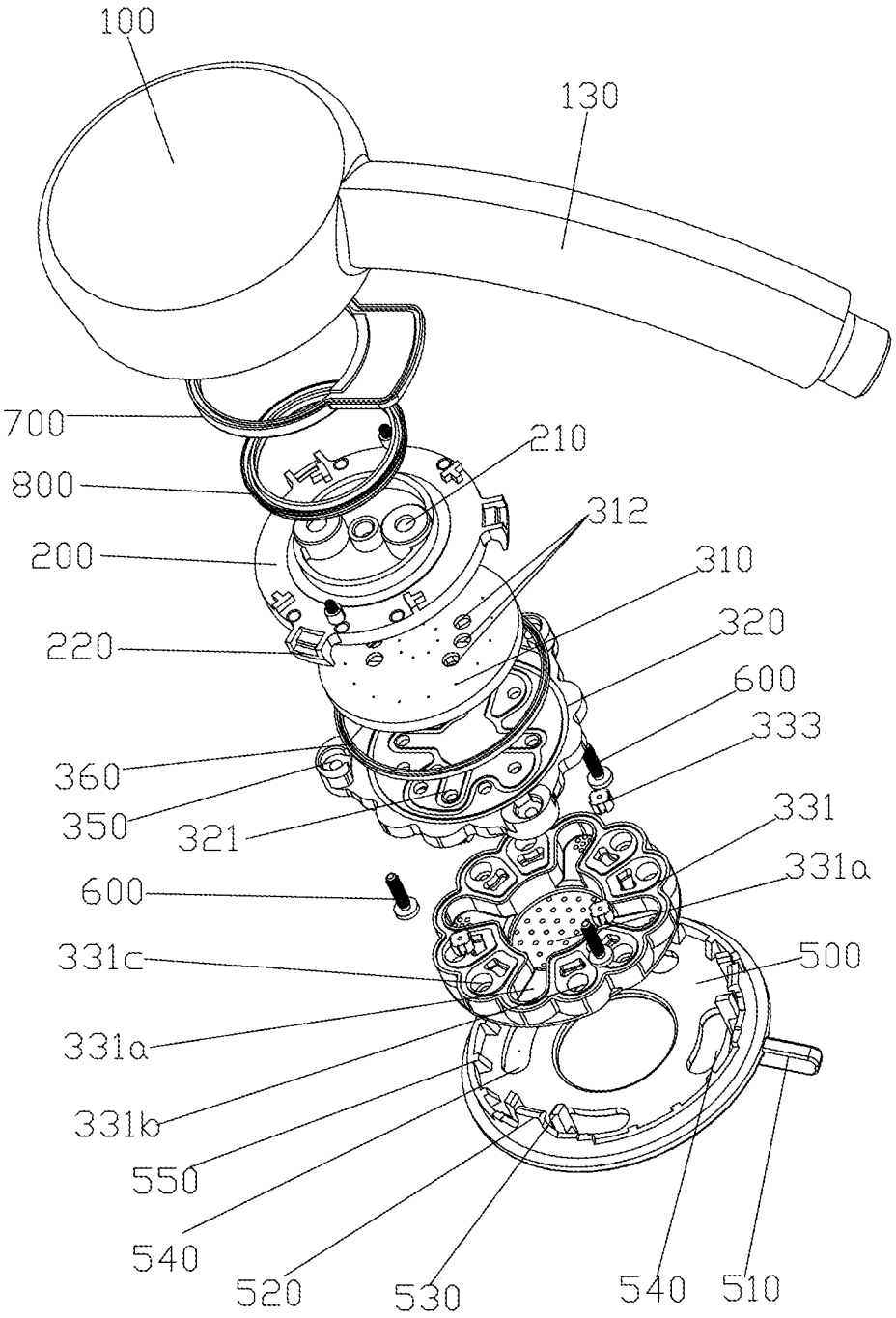
FIG. 2 illustrates an exploded diagram of a top view of the concealed top cover-type shower head of the preferred embodiment.
Figure 3:
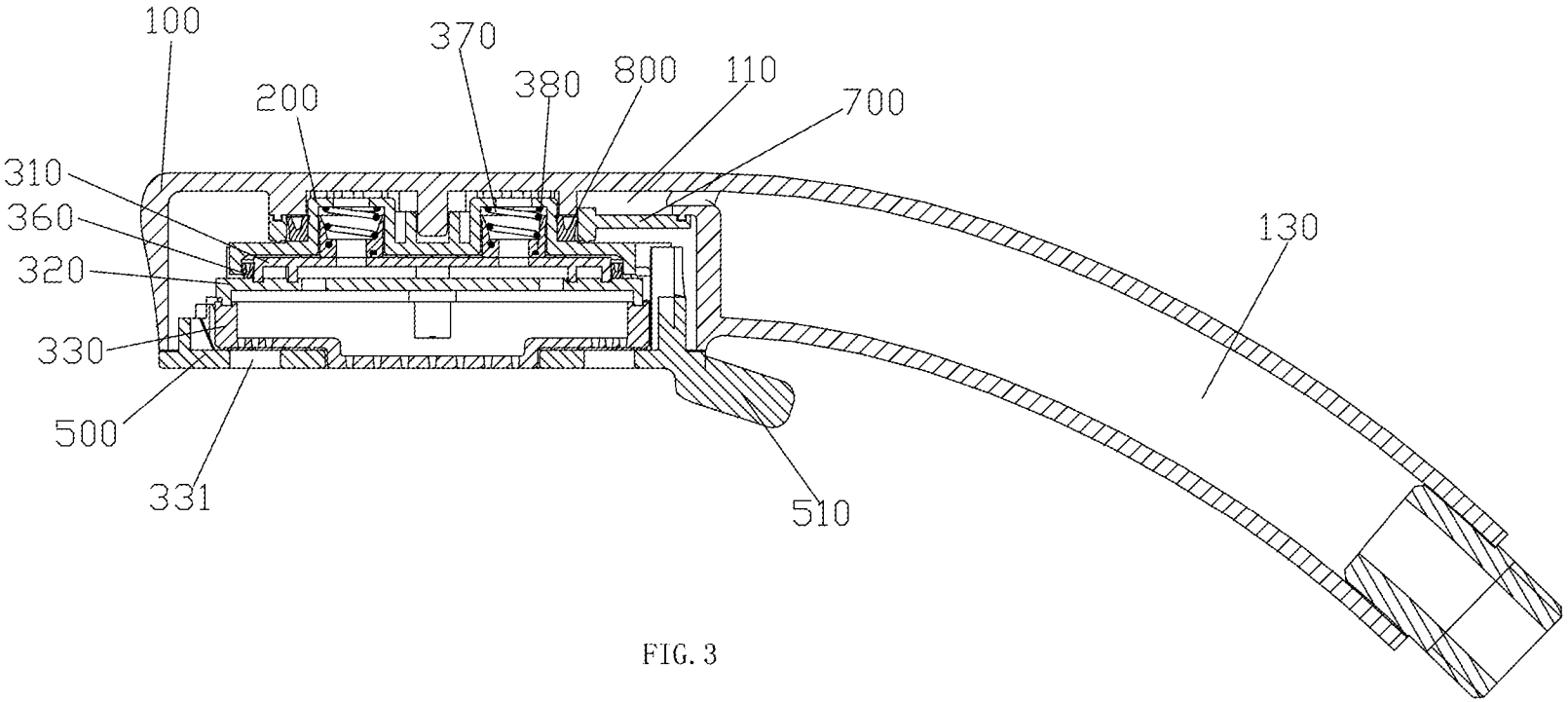
Figure 4:
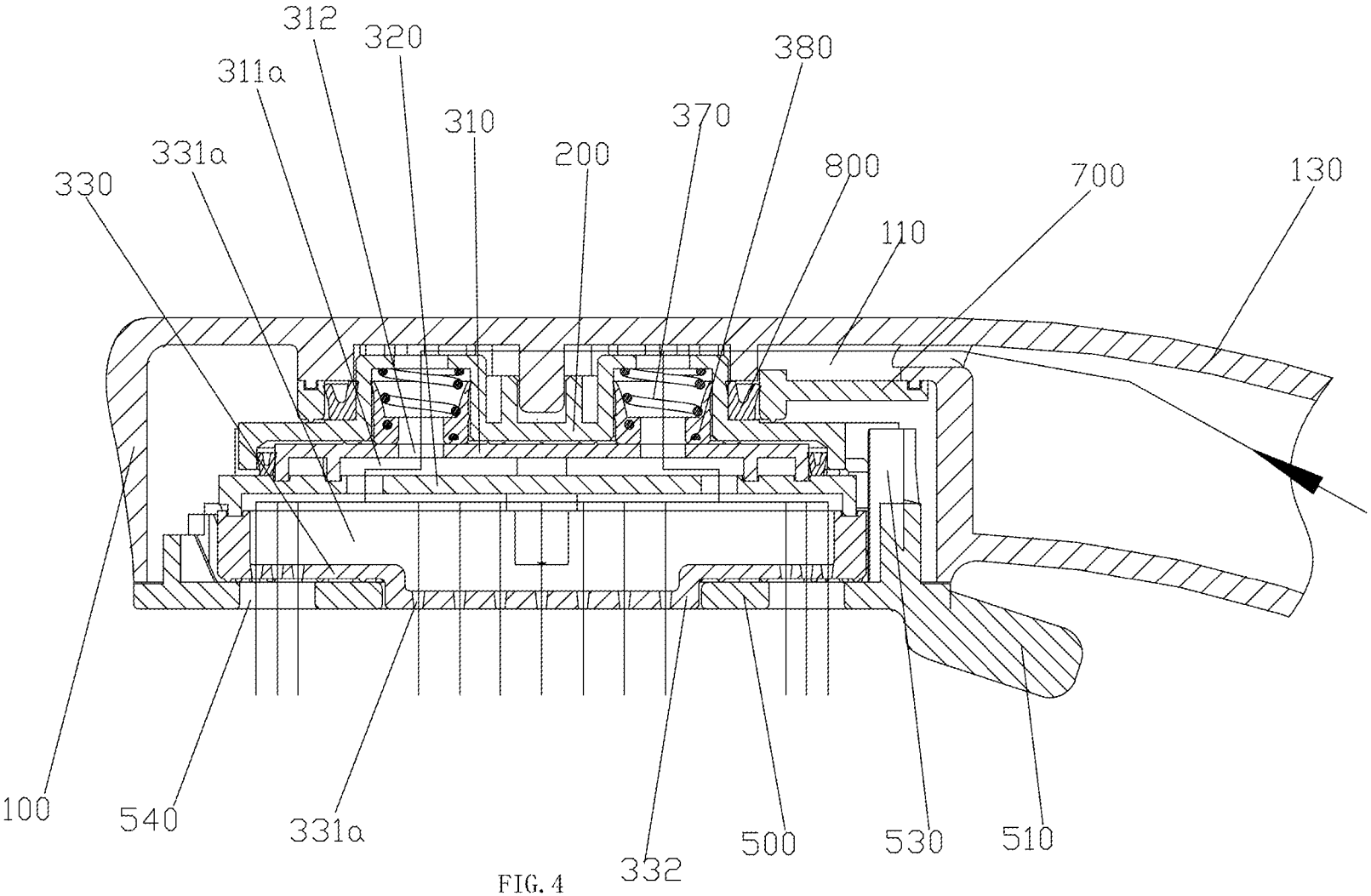
FIG. 4 illustrates a sectional view of the concealed top cover type shower head of the preferred embodiment in discharging shower water.
Figure 5:
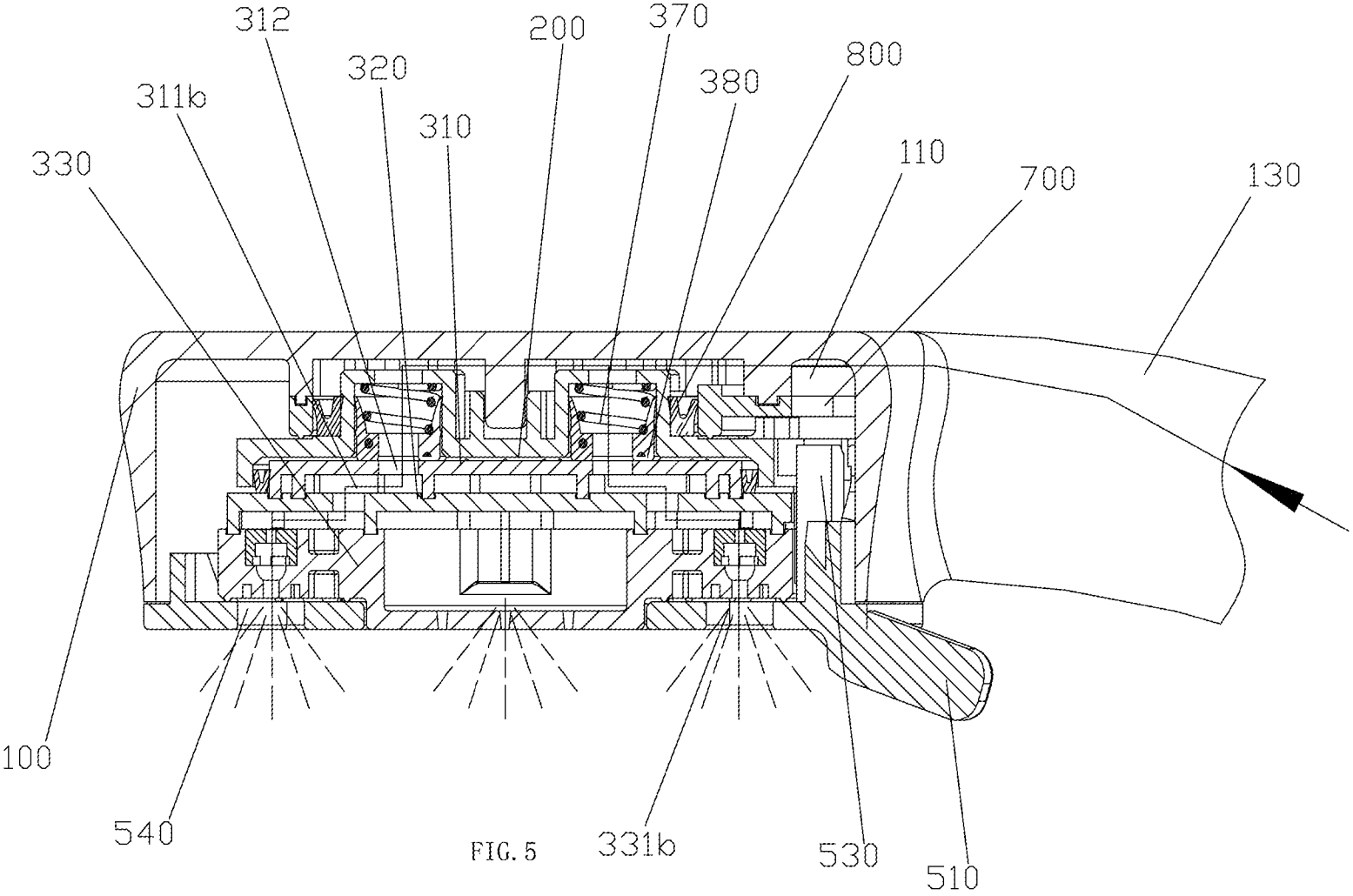
FIG. 5 illustrates a sectional view of the concealed top cover type shower head of the preferred embodiment in discharging spray water.
Figure 6:
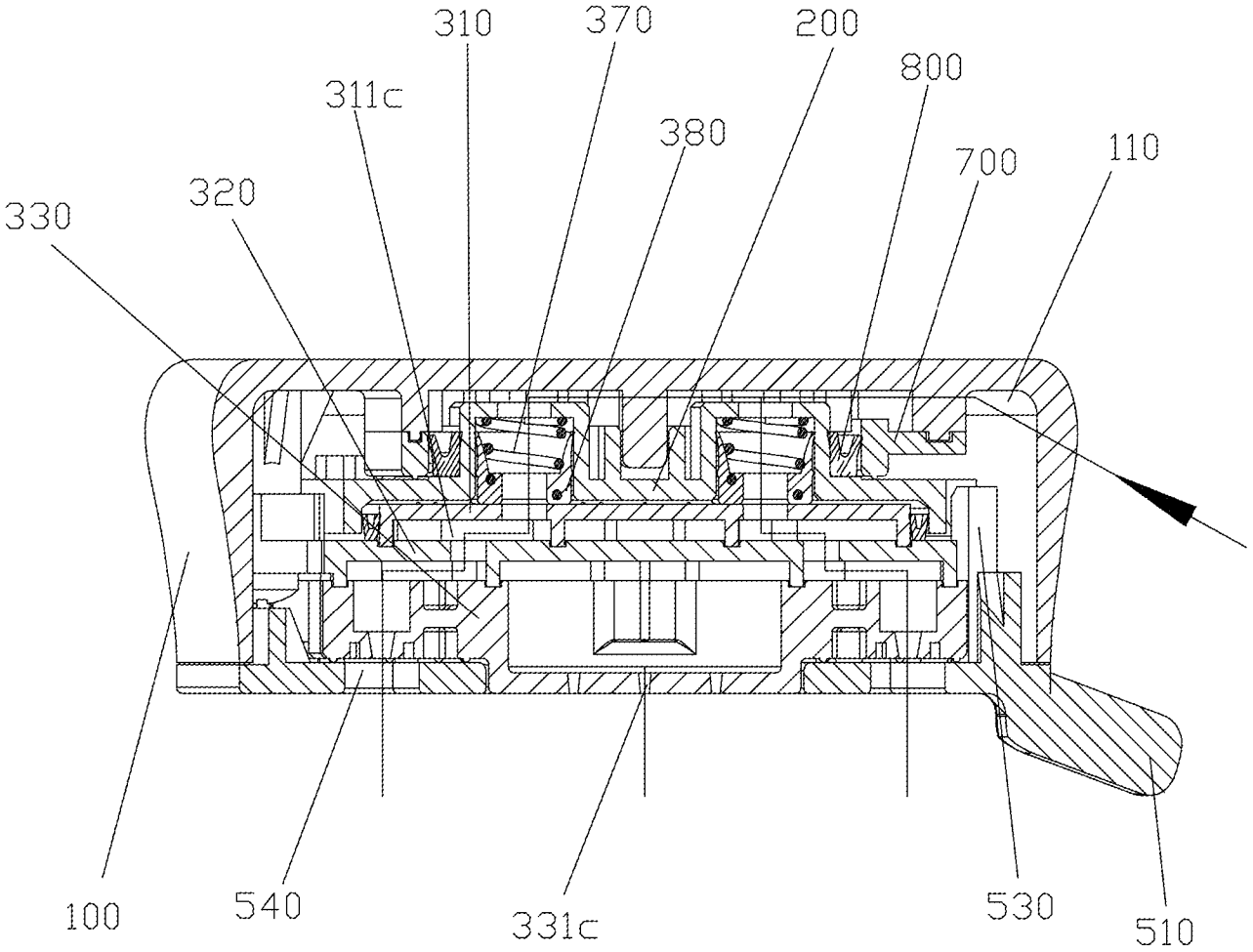
FIG. 6 illustrates a sectional view of the concealed top cover type shower head of the preferred embodiment in discharging injection water.

Pleaser refer to FIG. 1 to FIG. 6, a concealed top cover type shower head of the present invention comprises a shower head body 100, an inlet base 200, a water diversion mechanism 300 and a decorative cover 500.

The shower head 100 is disposed with an inlet waterway 110, a handle 130 and a screw set 120. In this embodiment, the shower hand body comprises a main body and a handle, the handle is fixed to the main body, the main body is disposed with an assembly cavity inside, the inlet waterway 110 passes through the main body into the assembly cavity of the main body; the screw set 120 is assembled inside the assembly cavity of the main body.

The inlet base 200 is rotatably assembled inside the shower head body 100 and is disposed with inlet holes 210, the inlet holes 210 are connected to the inlet waterway 110.

The water diversion mechanism 300 is fixed inside the shower head body 100 between the inlet base 200 and the decorative cover 500. It comprises a base body and a top cover 330 fixed together, the base body comprises a water diversion base 310 and a connection base 320. The water diversion base 310, the connection base 320 and the top cover 330 are fixed together, in this embodiment, by welding procedure, but not limited to this. The base body is disposed with a plurality of diversion waterways. In this embodiment, the water diversion base 310 abuts against the inlet base 200, the water diversion base 310 is disposed with diversion waterways 311*a*, 311*b*, 311*c*, each diversion waterway 311*a*, 311*b*, 311*c* is disposed with a diversion water hole 312, the diversion water holes 312 are switched to correspond to the inlet holes 210.

The top surface of the connection base 320 is disposed with a plurality of assembly grooves 322, which are coupled to and connected to the diversion waterways 311*a*, 311*b*, 311*c* of the water diversion base 310, the water holes 321 are evenly arranged inside the assembly groove 322 with intervals; the bottom surface of the connection base 320 is disposed with several sets of assembly cavities 323 of annularly spaced arranged, the top cover 330 is disposed with a plurality of outlet nozzles 331 of annularly spaced arranged, the central portion of the top cover 330 is protruded to define a protruding portion 332, each set of assembly cavities 323 is coupled to and connected to each set of outlet nozzles 331. The diversion water holes 312 of the diversion waterways 311*a*, 311*b*, 311*c* are switched to correspond to the inlet water holes 210 and to connect to the outlet nozzles 331 of the top cover 330 by the connection base 320, thus implementing switch of waterways, it is simple and compact structural.

The periphery of the water diversion mechanism 300 is raised with a plurality of screw holes 350, in this embodiment, the screw holes 350 are protruded and disposed in the base body, the shower head body 100 is disposed with a plurality of screw bases 120 corresponding to the crew holes 350, a plurality of screws 600 pass through the screw holes 350 of the water diversion mechanism 300. In this embodiment, the screw holes 350 are disposed with intervals and protruded in the periphery edge of the connection base 320, the connection base 350 is locked to the shower head body 100 by screws 600, the entire water diversion mechanism 300 is fixed to the shower head body 100. besides, a small clearance is disposed therebetween in the axial direction by locking the travel of the screw, so that the inlet base is rotatable in the circumferential direction, and the inlet holes of the inlet base respectively align with the diversion water holes of the water diversion base to switch the waterways.

The decorative cover 500 is covered part or whole of the top cover 330 and is rotatably disposed to the shower head body 100, the external periphery of the decorative cover 500 and the external periphery of the inlet base 200 are fixed relatively by assembly components, the decorative cover 500 is disposed with large through holes, the relative rotation of the decorative cover 500 and the top cover 330 makes the plurality of outlet nozzles switched to the large through holes. The decorative cover 500 is annular, the internal wall of the external ring thereof is disposed with a plurality of ribs 550, the internal ring of the annular decorative cover 500 is rotatably sleeved on the projection 332 of the top cover in sealing way. The appearance of the whole shower head is more attractive, the decorative cover is rotatable about the projection, thus making it with smaller friction and more labor-saving when rotating the decorative cover. Besides, the external periphery edge of the decorative cover 500 is disposed with a shifting block 510, which conforms to the user to rotate more easily. In this embodiment, the assembly component comprises lock covers 520 and side columns 530 spaced arranged in the external periphery of the decorative cover 500, and lock grooves 220 spaced arranged in the external periphery of the inlet base and coupled to the lock cover 520. By the cooperation of the lock covers 520 and the lock grooves 220, the decorative cover 500 and the inlet base 200 are fixed together. The assembly component is disposed between two adjacent screws 600. only turning the shifting block 510 to rotate the decorative cover 500 can drive the inlet base 200 to rotate to switch the plurality sets of the diversion waterways 311*a*, 311*b*, 311*c*, thus connecting to different outlet nozzles 331 to discharge different water patterns, the decorative cover 500 is only disposed with several large through holes, it can discharge different water patterns, it has simple structure and attractive appearance, dense outlet nozzles on the top cover 330 are invisible.

In this embodiment, there are two inlet holes 210; and six diversion water holes 312, the water diversion holes are divided into three sets of spaced arranged left and right in an annular and symmetrical rotationally, two inlet water holes 210 are respectively switched to connect to the three sets of diversion water holes 312; the diversion water holes 311*a*, 311*b*, 311*c* are mutually independent, they are a shower water waterway 311*a*, a spray water waterway 311*b* and a injection water waterway 311*c*, three sets of diversion water holes 312 are respectively correspondingly connected to the three diversion waterways 311; the top surface of the connection base 320 is disposed with three assembly grooves 322 coupled to and connected to the three diversion waterways 311*a*, 311*b*, 311*c*, and twelve diversion water holes 321, each assembly groove 322 is disposed with four water holes 321 annularly spaced arranged. The top cover 330 is disposed with three sets of outlet nozzles 331 of annularly spaced arranged, they are shower water outlet nozzles 331*a*, spray water outlet nozzles 311*b* and injection water outlet nozzles 311*c*, the spray water outlet nozzles 311*b* are disposed with reverser 333, each set of outlet nozzles 331 has four sets of outlet holes of evenly spaced arranged with a same water effect; the bottom surface of the connection base 320 is disposed with three sets of assembly cavities 323 coupled to and connected to the three sets of outlet nozzles 331. The large through hole of the decorative cover 500 is disposed with four arc holes 540 of evenly spaced arranged, the arc holes 540 are switched to correspond to each set of outlet nozzles 331. The projection 332 of the top cover 330 is connected to the shower type outlet nozzles 331*a*, the projection 332 is disposed with shower water outlet nozzles 331*a* as well, so that when switched to shower mode, water not only flows out of the periphery evenly, but also flows out of the projection 332 of the top cover 330. Rotating the decorative cover 500 to drive the inlet base 200 to rotate, two inlet holes 210 are switched to correspond to the two diversion water holes 312, so as to connect to one diversion waterway 311*a*, 311*b*, 311*c*, then four water holes 321 of each assembly groove 322 of the connection base 320 is connected to one set of outlet nozzles 331 of the top cover 330, each set of outlet nozzles 331 have four outlet holes, then water flows out of the four arc holes 540 of the rotation base 500 to generate one kind of water pattern. In this embodiment, there are three kinds of water patterns, shower water pattern, spray water pattern, injection water pattern, but not limited to this, by designing different diversion waterways 311*a*, 311*b*, 311*c*, it can implement different water patterns.

The water diversion mechanism 300 is further disposed with a sealing ring 360, the sealing ring 360 is sleeved between the water diversion base 310 and the inlet base 200 in sealing way; the inlet hole 210 is disposed with a spring 370 and a sealing piece 380 with through hole, the sealing piece 380 is slidably disposed inside the inlet hole 210, the spring 370 abuts against the sealing piece 380 and the inlet hole 210. In this embodiment, the shower head is further disposed with a water barrier 700 fixed inside the shower head body to close the inlet waterway 110; a packing ring 800 is further disposed, the packing ring 800 is sleeved between the inlet base 200 and the water barrier 700. The water barrier 700 and the inlet base 200, the inlet base 200 and the water diversion base 310, the top cover 330 and the decorative cover 500 are connected together by point contacts. So that when the shower head is switched, it reduces friction effectively and ensures a handle feeling of switch.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a concealed top cover type shower head, which is designed ingeniously and reasonably, it meets the satisfy of different water patterns only by rotating the decorative cover and disposing several large through holes in the decorative cover, the structure is simple and the appearance is attractive.

The invention claimed is:

1. A concealed top cover type shower head, comprising:

a shower head body with an inlet waterway;

an inlet base, with a plurality of inlet holes and a plurality of lock grooves, rotatably mounted inside the shower head body, the inlet holes being in communication with the inlet waterway;

a water diversion mechanism, disposed inside the shower head body with a plurality of diversion waterways and a top cover, connecting the plurality of diversion waterways to the plurality of inlet holes, the top cover having a projection outlet and a plurality sets of outlet nozzles distributed around the projection outlet, each set of outlet nozzles being annularly arranged with intervals and respectively connected to the diversion waterways; and a first cover, with a peripheral surface with a center opening and a plurality through holes distributed around the center opening, a shifting block attached to the peripheral surface, and a plurality of lock covers extending upwardly away from the peripheral surface, rotatably assembled on the shower head body, for covering at least partially the top cover, an external periphery of the first cover and an external periphery of the inlet base being connected together by an assembly component, the plurality sets of the outlet nozzles being connected to the corresponding through holes and some of, not all of, the plurality sets of outlet nozzles being exposed, such that jets from the exposed outlet nozzles pass through at least one through hole of the first cover, wherein the plurality of lock covers on the first cover engage the plurality of lock grooves on the inlet base, the first cover attaches to the inlet base and encloses the top cover, the water diversion mechanism, and the a plurality of diversion waterways between the first cover and the inlet base.

2. The concealed top cover type shower head according to claim 1, wherein a periphery of the water diversion mechanism is protruded with several screw holes, a plurality of screw bases corresponding to the screw holes are distributed along a periphery inside the shower head body, a plurality of screws pass through the screw holes of the water diversion mechanism and screw to the screw bases; an assembly component is disposed between each two adjacent screws; the water diversion mechanism is disposed between the inlet base and the decorative cover.

3. The concealed top cover type shower head according to claim 1, wherein a central portion of the top cover is protruded with a projection, the first cover is annular, the annular first cover is rotatably sleeved on the projection in sealing way.

4. The concealed top cover type shower head according to claim 1, wherein the water diversion mechanism further comprising a water diversion base, the water diversion base abuts against the inlet base; the diversion waterways are disposed on the water diversion base, each diversion waterway is disposed with a diversion water hole, the diversion water holes are switched to correspond to the inlet holes.

5. The concealed top cover type shower head according to claim 4, wherein the water diversion mechanism further comprising a connection base with a plurality of water holes, the connection base, the water diversion base and the top cover are fixed together; a top surface of the connection base is disposed with a plurality of assembly grooves, the assembly grooves are coupled to and connected to the diversion waterways of the water diversion base, the water holes are evenly arranged with intervals inside the assembly grooves; a bottom surface of the connection base is disposed with a plurality sets of assembly cavities of annularly arranged with intervals, each set of assembly cavity is coupled to and connected to one set of outlet nozzles.

6. The concealed top cover type shower head according to claim 5, wherein comprising two inlet holes; six diversion water holes divided into three sets of annularly arranged with intervals, two inlet holes are respectively switched to connect to the three sets of diversion water holes; three diversion waterways are mutually independent, a shower water waterway, a spray water waterway and an injection water waterway, three sets of the water holes are respectively connected to the three diversion waterways; the top surface of the connection base is disposed with three assembly grooves coupled to and connected to the three diversion waterways, the water holes are annularly arranged with intervals inside the three assembly grooves.

7. The concealed top cover type shower head according to claim 6, wherein the top cover is disposed with three sets of outlet nozzles of annularly arranged with intervals, which are a shower water outlet nozzles, a spray water outlet nozzles and an injection water outlet nozzles; the bottom surface of the connection base is disposed with three sets of assembly cavities coupled to and connected to the three sets of outlet nozzles.

8. The concealed top cover type shower head according to claim 1, wherein the water diversion mechanism further comprising a sealing ring, the sealing ring is sleeved between the water diversion base and the inlet base in sealing way; the inlet hole is disposed with a spring and a sealing piece with a through hole, the sealing piece is slidably disposed inside the inlet hole, the spring abuts against the sealing piece and the inlet hole; the external periphery of the first cover is further disposed with a shifting block.

9. The concealed top cover type shower head according to claim 1, wherein further comprising a water barrier fixed to the shower head body to close the inlet waterway; further comprising a packing ring, the packing ring is sleeved between the inlet base and the water barrier in sealing way.

10. The concealed top cover type shower head according to claim 1, wherein the water barrier and the inlet base, the inlet base and the water diversion base, the top cover and the first cover are respectively connected together by point contacts.

11. The concealed top cover type shower head according to claim 3, wherein the internal wall of the external ring of the annular first cover is disposed with a plurality of ribs, the internal ring of the annular first cover is rotatably sleeved on the projection of the top cover in sealing way, the top cover and the first cover are connected together by point contacts.

* * * * *